United States Patent [19]

Zur

[11] 4,356,581

[45] Nov. 2, 1982

[54] BEARING SYSTEMS FOR BRIDGES, OVERPASSES AND STRUCTURES

[76] Inventor: Henry C. Zur, 3222 W. Daily, Phoenix, Ariz. 85023

[21] Appl. No.: 108,748

[22] Filed: Dec. 31, 1979

Related U.S. Application Data

[63] Continuation-in-part of Ser. No. 841,096, Oct. 11, 1977, Pat. No. 4,181,995.

[51] Int. Cl.[3] ..... E01D 19/02

[52] U.S. Cl. ..... 14/75; 405/204; 211/207

[58] Field of Search ..... 14/75; 405/202, 204; 248/632; 299/91; 403/326; 267/141.3, 141.2, 141.1; 211/207, 208

[56] References Cited

U.S. PATENT DOCUMENTS

| | | | |
|---|---|---|---|
| 498,559 | 5/1893 | Marsh | 14/75 |
| 2,555,637 | 6/1951 | Fischer | 248/632 |
| 3,268,260 | 8/1966 | Snipe | 299/91 |
| 3,930,437 | 1/1976 | Guntert | 403/379 X |
| 4,227,833 | 10/1980 | Plester | 405/299 |

FOREIGN PATENT DOCUMENTS

| | | | |
|---|---|---|---|
| 1270403 | 7/1961 | France | 14/75 |

*Primary Examiner*—Nile C. Byers, Jr.

[57] ABSTRACT

A bearing assembly for structures composed of two main elements each of which forms a portion of either the supported structure or the supporting structure or foundation. One of these main elements is formed in a "U" type shape and provided with flutings on the interior sides facing each other. The other main element is formed to fit into the interior of the other "U" type main element and is provided with flutings on opposing sides of said element. As one main element is inserted into the other, the flutings of both elements can be aligned to face each other, and complementary cores inserted. Two or more of such cores inserted at opposing sides of the inserted element, would position the inserted main element securely into the other main element, the cores filling the flutings of the "U" type main element and thus providing a secure positioning to the supported structure. To provide a certain degree of flexibility, as may be required for such structures as bridges, the cores inserted into the opposing flutings could be made from flexible material, and thus permitting for a limited movement, but nevertheless holding the supported structure securely against any upward pressure which may be caused by earthquakes or bombings.

8 Claims, 3 Drawing Figures

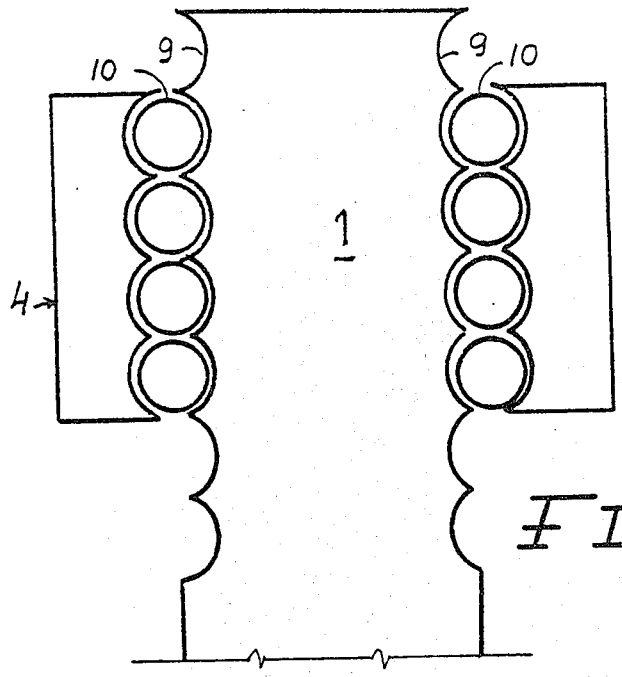
FIG. 1
FIG. 2
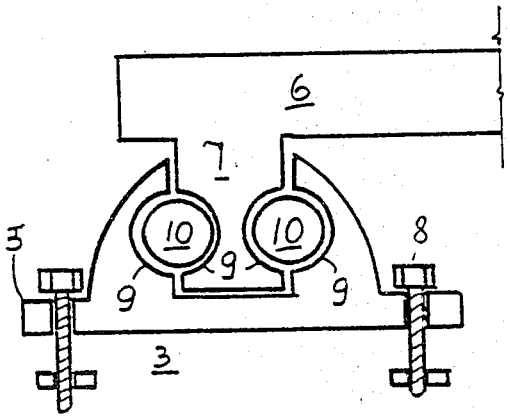
FIG. 3
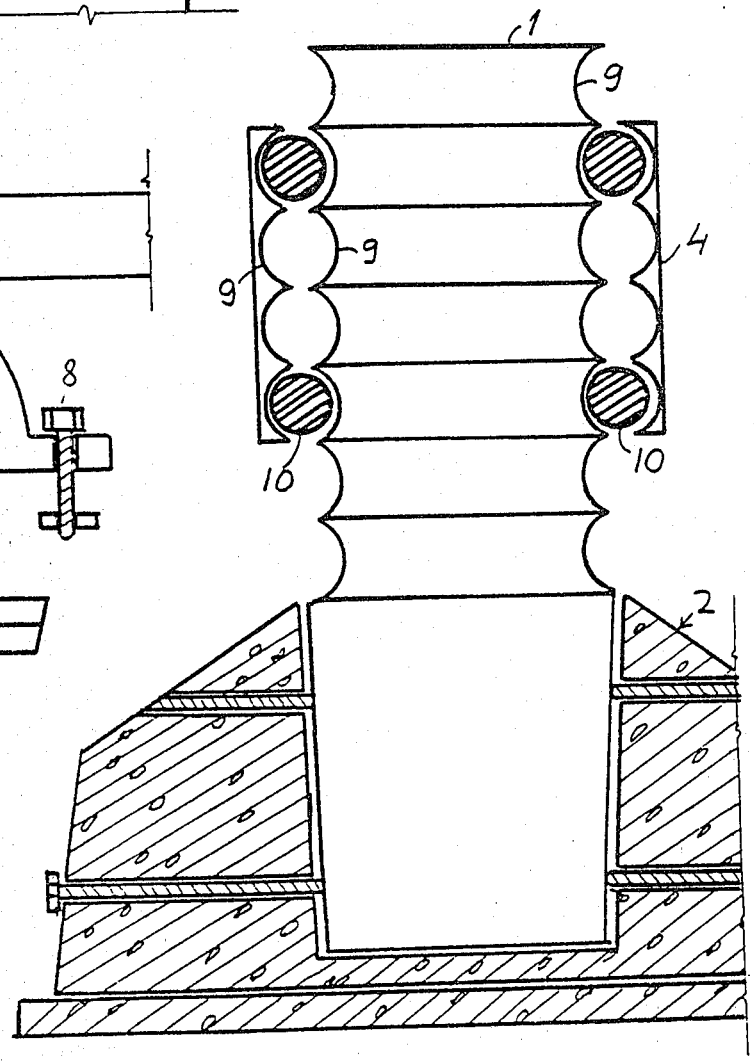

BEARING SYSTEMS FOR BRIDGES, OVERPASSES AND STRUCTURES

This application is a continuation-in-part of my application Ser. No. 841,096 filed Oct. 11, 1977 now U.S. Pat. No. 4,181,995, and it is made in order to achieve protection in particular for the improved bearing and securing system for the general use in positioning and securing heavy structures, as distinguished from the protection to be granted under the above serial number, when it is applied in conjunction with the bridging and overpass system.

HISTORY OF THE INVENTION

Since long structures such as bridges need a certain degree of flexibility in their positioning to their supports or foundations, to provide for any variations which may be caused by a shaft of ground or otherwise, it has been customary to position such structures mainly onto bearings which mostly are formed with a rounded element extending upward from a bolted down baseplate secured to the support or foundation, and a halfround complementary bearing element secured to the bridge or structure and resting on the rounded bearing element, and thus permitting a certain degree of flexibility and adoption of the supported structure to the movement of the supporting structure.

However, it has been found that the systems used for the positioning of bridges in the above described or other manners are not satisfactory, as they do not secure the positioned structure against any upward pressure as may be caused by earthquackes, bombardements or other sources.

OBJECTS OF THE INVENTION

1. To provide a combined bearing and securing system for bridges and heavy structures;
2. To provide such bearing system with a degree of flexibility by means of inserting flexible cores between opposing flutings, said flutings being formed and part of the elements serving as support and supported portions, and wherein one such element is held and secured to the other element by being held by means of at least two opposing cores inserted on opposite side of one element and resting in the complementary flutings of another enveloping element.

SUMMARY OF THE INVENTION

With the afore mentioned objectives in mind, a bearing system has been developed by the inventor to provide for the secure positioning of structures and in particular for heavy structures such as bridges.

As in the case of a bridge structure, a portion of said bridge-structure extends downward to rest on the foundation. Using this new method, the downward extending portion would be formed with flutings at opposing sides while the upward extending portion of the formation would form a "U" type structure wherein the sides facing the middle of said "U" would be formed with complementary flutings. While these flutings could be given any suitable shape, a half-round shape would be probably the prefered form. Is now the downward extending portion of the bridge structure inserted in said "U" of the foundation, it can be secured by insertion of complementary cores of a round shape into the halfround flutings on both sides of the downward extending bridge portion, whereby the cores rest with their other sides in the half-round flutings of the "U" shaped portion extending from the foundation.

Once these cores are inserted, between the supporting and the supported element, the thus positioned structure is secured against an upward or downward movement, and if the cores are made from flexible material such as rubber, a certain degree of flexibility would be provided as may be required in particular in bridges or long overpasses.

To strengthen the positioning of a heavy structure, the opposing elements could be provided with a number of parallel horizontal flutings into which a desired number of cores could be inserted. A plurality of flutings would also permit a variable positioning as may be required to adjust for height. It is evident, that both the upper or the lower elements can form the "U" or the receiving part of the bearing while the other element would then be the inserted portion.

DESCRIPTION OF THE DRAWINGS

FIG. 1 is a sectional view of a column extending upward, provided with half-round flutings onto which a slotted beam has been positioned by means of inserting round cores.

FIG. 2 is a similar sectional view of a column extending upward from a base onto which a slotted beam has been positioned by means of cores inserted into complementary flutings of both elements.

FIG. 3 is a sectional view of a preformed bearing, to be secured with bolts to a foundation, into which a portion of a bridge structure has been inserted and secured by means of cores inserted into complementary flutings.

DESCRIPTION OF PREFERRED EMBODIMENTS OF THE INVENTION

While the drawings show variations of the same system of securely positioning a structure, and the variable positioning as in FIGS. 1 and 2, a simplified bearing is shown in FIG. 3. The downward extending portion 7 of the structure or bridge 6 is shown extending downward into the bearing-assembly 3. The inner sides of the bearing assembly are formed with flutings 9 opposing each other. The downward extending portion of the supported structure is also provided with complementary flutings at both sides also shown as 9. Two cores 10 are inserted between the flutings 9 at opposing sides, and thus securely hold the supported structure. Preferably, the cores would be of flexible material and thus expand into the flutings to form a thight fit. The insertion of the cores would be accomplished by various methods, and in the case of flexible cores a simple method would be to press the structure by means of jacks into one direction, insert the core into the formed greater space on one side and then reverse the pressure into the opposite direction and insert the opposing core. The bottom portion 5 of the bearing assembly is secured by means of bolts 8 to the support element.

In FIGS. 1 and 2 the bearing system is combined with a variable positioning as may be required to achieve the necessary adjustments for height when a number of adjacent structures such as bridges or overpasses have to be positioned. In both drawings, a column 1 is extending upward. A slotted beam 4 has been lowered onto the column with the column extending through the slot. Both the beam and the column are provided with half-round flutings 9 into which cores 10 have been inserted. As shown in FIG. 2, only a certain number of cores, to provide the required strength needs to be inserted. The column 1 is shown here positioned into a base 2.

It is evident that the flutings can be of any suitable shape, and the cores formed accordingly. The embodiments described hereein are for explanation only and not to limit the scope of the invention.

What I claim is:

1. A bearing assembly for bridges and heavy structures formed of three main elements which assemble to form the bearing as follows:

a. a "U" type shaped female receiving element formed with horizontal flutings on the vertical sides formed in the interior of said female "U" type element and provided with means positioning and securing said element to the supported structure;

b. a male shaped element, inserted and fitted into the recess of said "U" type receiving element and formed with horizontal flutings on its outer vertical sides, shaped to align with the flutings of of the receiving element and provided with means positioning and securing said inserted element to the supported structure;

c. cores fitting within and filling the opposing recesses formed by said flutings of the opposing vertical sides of the inserted and the receiving elements, when said flutings have been aligned to correspond, providing for the insertion of at least one core on each of the opposing sides of the inserted elements, and whereby the supported structure is positioned and secured to the supporting structure.

2. The bearing assembly for structures of claim 1, wherein the upward extending portion of the support structure is formed into a column of a a male-type shape and provided with flutings at its sides, and the supported structure positioned on said column is forming an inverted "U" to receive the upward extending portion of the column, and wherein said both portions are provided with complementary flutings to receive cores at opposing sides, in order to position the supportrd structure and secure it against movements except those which are required for flexability.

3. The bearing assembly for structures of claim 1, wherein the cores are made from flexible material, and provide the supported structure with a certain flexibility.

4. The bearing Assembly for structures of claim 1, wherein the insert cores are of a geometrical shape, and the flutings of the downwad and upward extending portions of the support and the supported structure take the form of part of said geometrical shape.

5. The bearing assembly for structures of claim 1, wherein the insert cores are round and the flutings to receive said cores are half-round.

6. The bearing assembly of claim 1, wherein the support portion of the structure take the form of upward extending columns.

7. The bearing assembly of claim 1 and 6, wherein the columns are fluted horizontally at opposing sides and provide for a variable height positioning of the supported structure.

8. The bearing assembly for structures of claim 1, wherein the position of the bearing assembly of the supporting structure and the supported structure is reversed, and the portion of the supported structure extending downward into the bearing assembly forms the "U" type shape into which an upward extending portion of the support structure is inserted.

* * * * *